US008051749B2

(12) United States Patent
Gustafson et al.

(10) Patent No.: US 8,051,749 B2
(45) Date of Patent: Nov. 8, 2011

(54) POSITIVE PIVOT CENTERS FOR ADJUSTABLE TOOLS

(75) Inventors: Eric Gustafson, Pleasant Prairie, WI (US); Glenn Kaufman, Racine, WI (US); Garry Dillon, Kenosha, WI (US)

(73) Assignee: Snap-On Incorporated, Kenosha, WI (US)

( * ) Notice: Subject to any disclaimer, the term of this patent is extended or adjusted under 35 U.S.C. 154(b) by 0 days.

(21) Appl. No.: 12/462,177

(22) Filed: Jul. 30, 2009

(65) Prior Publication Data

US 2010/0031785 A1 Feb. 11, 2010

Related U.S. Application Data

(60) Provisional application No. 61/137,390, filed on Jul. 30, 2008.

(51) Int. Cl.
*B25B 7/10* (2006.01)
*B25B 7/04* (2006.01)

(52) U.S. Cl. ..... 81/416; 81/411

(58) Field of Classification Search ..... 81/416, 81/417, 412, 411, 394, 415
See application file for complete search history.

(56) References Cited

U.S. PATENT DOCUMENTS

| | | | | |
|---|---|---|---|---|
| 252,248 | A | | 1/1882 | Pease |
| 466,879 | A | | 1/1892 | Dixon |
| 1,123,243 | A | | 1/1915 | Champ |
| 1,344,629 | A | | 6/1920 | Fowler |
| 1,426,362 | A | | 8/1922 | Cook |
| 1,438,952 | A | | 12/1922 | Evans |
| 1,475,642 | A | | 11/1923 | Mathis |
| 1,520,613 | A | | 12/1924 | Thim |
| 1,558,399 | A | | 10/1925 | Rylen |
| 1,772,224 | A | | 8/1930 | Peterson |
| 1,800,447 | A | | 4/1931 | Froeschl |
| 1,836,473 | A | * | 12/1931 | Kob ..... 81/411 |
| 1,867,912 | A | | 7/1932 | Evey |
| 2,464,145 | A | | 3/1949 | Mead |
| 2,483,380 | A | * | 9/1949 | Duffy ..... 81/412 |
| 2,707,895 | A | | 5/1955 | Mead |
| 2,779,224 | A | | 1/1957 | Coggbum |
| 3,685,097 | A | * | 8/1972 | Scott et al. ..... 81/416 |
| 3,862,776 | A | | 1/1975 | Sims et al. |

(Continued)

OTHER PUBLICATIONS

International Preliminary Report on Patentability dated Feb. 1, 2011 and Written Opinion, etc., dated Oct. 2, 2009 re PCT/US2009/004404.

*Primary Examiner* — Hadi Shakeri
(74) *Attorney, Agent, or Firm* — Seyfarth Shaw LLP

(57) ABSTRACT

There is disclosed herein an improved adjustable tool, such as a pair of pliers, having a first jaw portion and a second jaw portion, the first and second jaw portions being pivotably connected to one another by a pivot pin attached in any manner to one of the jaw portions and fitted within a channel defined within the other of the jaw portions. Preferably, the channel is formed by a plurality of pivot centers, including two non-adjacent terminal centers and at least one intermediate center, each center being connected to at least one other center by a slot to form a single pathway such that travel of the pivot pin between non-adjacent pivot centers requires travel through at least one intermediate pivot center, and the pivot pin has a positive tactile indication when properly seated in each pivot center.

7 Claims, 7 Drawing Sheets

U.S. PATENT DOCUMENTS 4,296,655 A * 10/1981 Tesoro ..... 81/412
4,890,519 A 1/1990 Le Duc
5,176,048 A * 1/1993 Jore et al. ..... 81/416
5,950,314 A 9/1999 Chang
6,019,020 A 2/2000 Liou
6,026,714 A 2/2000 Chang
6,041,680 A 3/2000 Wang
6,092,291 A 7/2000 Cendoma
6,098,508 A * 8/2000 Battistone ..... 81/416
6,658,738 B1 12/2003 King
6,694,848 B1 2/2004 Flavigny
6,941,663 B2 9/2005 Still
7,191,688 B1 3/2007 Hall, Jr.
7,406,898 B1 * 8/2008 Hall, Jr. ..... 81/411
2003/0140742 A1 7/2003 Nouvel
2004/0129117 A1 7/2004 Hirse

* cited by examiner

POSITIVE PIVOT CENTERS FOR ADJUSTABLE TOOLS

RELATED APPLICATION

This application claims the priority of, and hereby incorporates by reference, provisional application Ser. No. 61/137,390 filed Jul. 30, 2008.

TECHNICAL FIELD OF THE INVENTION

The present device relates to adjustable tools. Particularly, the present device relates to adjustable tools having distinct pivot centers linked by channels for altering, for example, jaw clamping width.

BACKGROUND OF THE INVENTION

Hand tools have been around for years in many forms. To increase the usefulness of some hand tools, features were developed to allow the tools to adjust to varying workpiece sizes. That is, instead of changing to a bigger or smaller tool, a single tool could be adjusted to accommodate a larger or smaller sized workpiece, saving on time and the number of tools required for any given job.

One such feature developed to make tools adjustable is the use of multiple pivoting centers for jawed hand tools, such as pliers. A pivot attached to one half of the tool is capable of freely sliding between any number of centers connected by slots. Typically, three pivoting centers are used for engaging a small, medium and large workpiece.

U.S. Pat. No. 1,867,912 to Evey discloses one way for providing a path to connect each of the three pivot centers. The centers are connected by adjoined slots/paths such that each pivot center is at the end of a slot. However, manipulation of the tool halves to move irregularly between pivot centers is unnecessarily complex for the user, and may require visual confirmation of proper pivot centering.

A more popular alternative adjustment design is illustrated in U.S. Pat. No. 1,520,613 to Thim. The single-slot or path having multiple (e.g., three) pivot centers at regular points just off the path requires less complex manipulation to move between centers (i.e., pin travel along the slot is substantially linear, but "locking" into a pivot center still requires a slight transverse movement of the pivot pin). However, movement and centering may still be overly complex and require visual confirmation.

The present instrument in its various embodiments provides a solution to these and other problems in the relevant field.

SUMMARY OF THE INVENTION

There is disclosed herein an improved adjustable tool which avoids the disadvantages of prior devices while affording additional structural and operating advantages.

Generally speaking, an adjustable tool is disclosed comprising a first jaw portion and a second jaw portion, the first and second jaw portions being pivotably connected to one another by a pivot pin attached to one of the jaw portions fitted within a channel defined within the other of the jaw portions. Preferably, the channel comprises a plurality of pivot centers, including two non-adjacent terminal centers and at least one intermediate center, each center being connected to at least one other center by a slot to form a single pathway such that travel of the pivot pin between non-adjacent pivot centers requires travel through at least one intermediate pivot center, and the pivot pin has a positive indication when properly seated in each pivot center.

In a first embodiment, each of the at least one intermediate pivot center connects to two slots and the center line of the two slots form an angle. Preferably, the angle is in the range of from about 175 degrees to about 160 degrees. More preferably, the angle is in the range of from about 170 degrees to about 166 degrees. Most preferably, the angle is about 168 degrees.

In another embodiment, each of the at least one intermediate pivot center comprises a recessed pocket for seating the pivot pin. The adjustable tool of this embodiment may comprise a linear pathway—i.e., an angle of 180 degrees between center lines of two slots adjacent to intermediate pivot centers.

In still another embodiment, the width of each slot is identical and the diameter of each pivot center is identical. While the slots are parallel to one another, the center line of each slot and the center point of each adjacent pivot center are offset from that of one another such that passing through any intermediate pivot center requires at least a slight directional adjustment. The adjustable tool of this embodiment may comprise a linear or substantially linear pathway.

Preferably, the number of pivot centers in each embodiment is three. However, the number of pivotal centers may certainly be greater than three for some applications.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
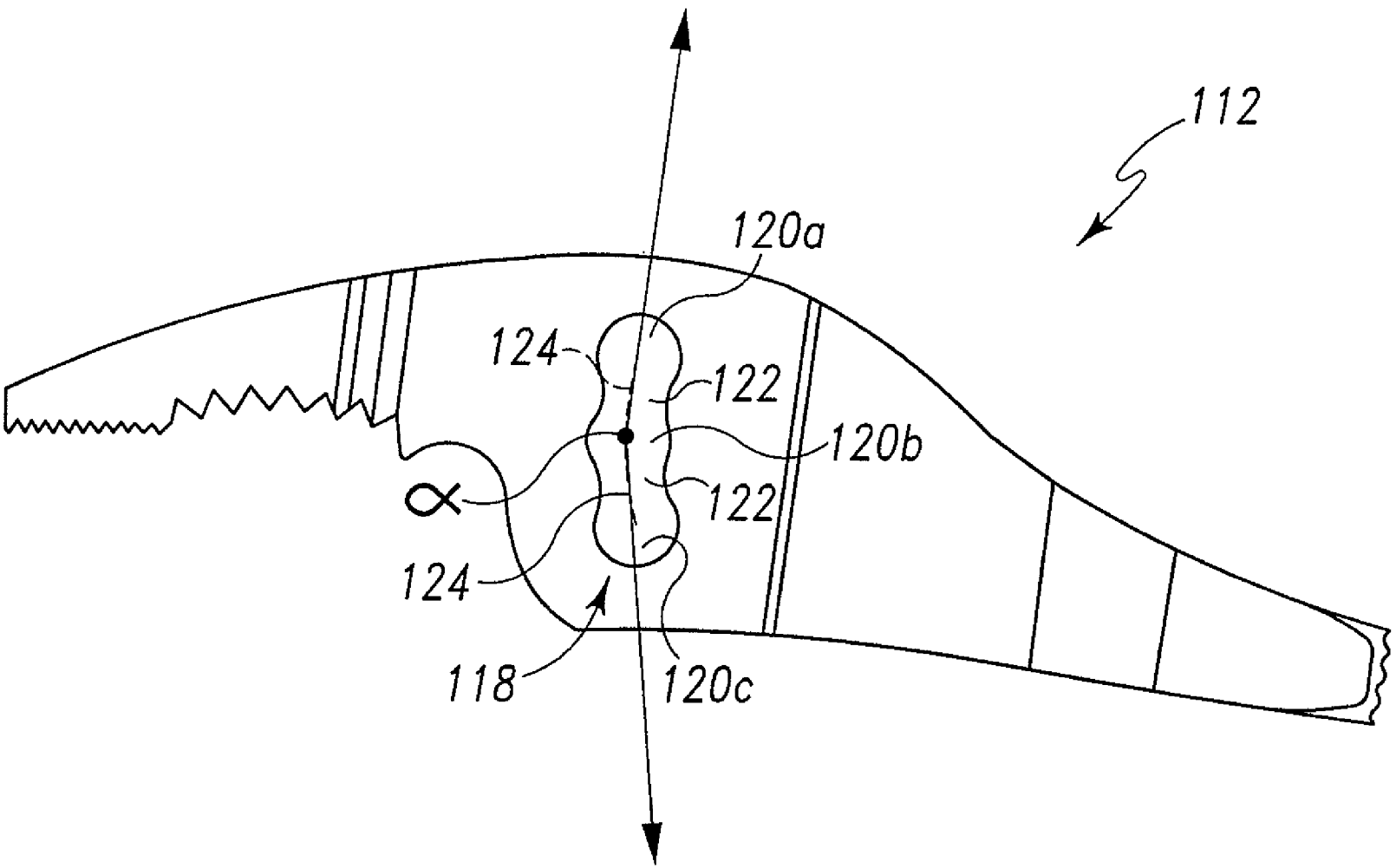
FIG. 1 is a side view of one embodiment of a jaw portion having a guide channel defined therein.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Figure 3:
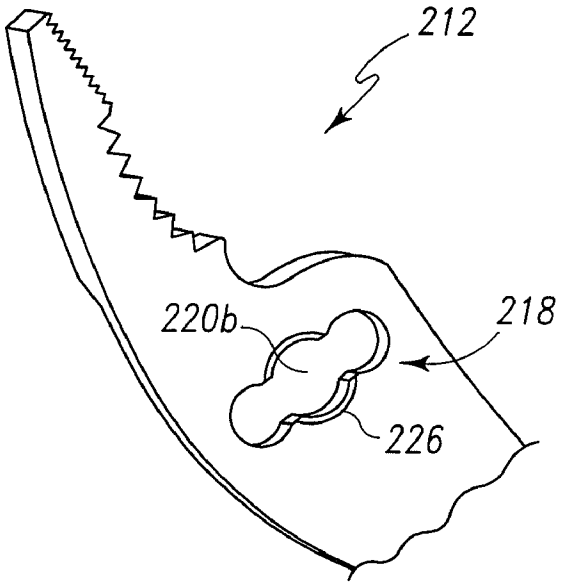
FIG. 3 is a perspective view of the embodiment of FIG. 2.
Figure 2:
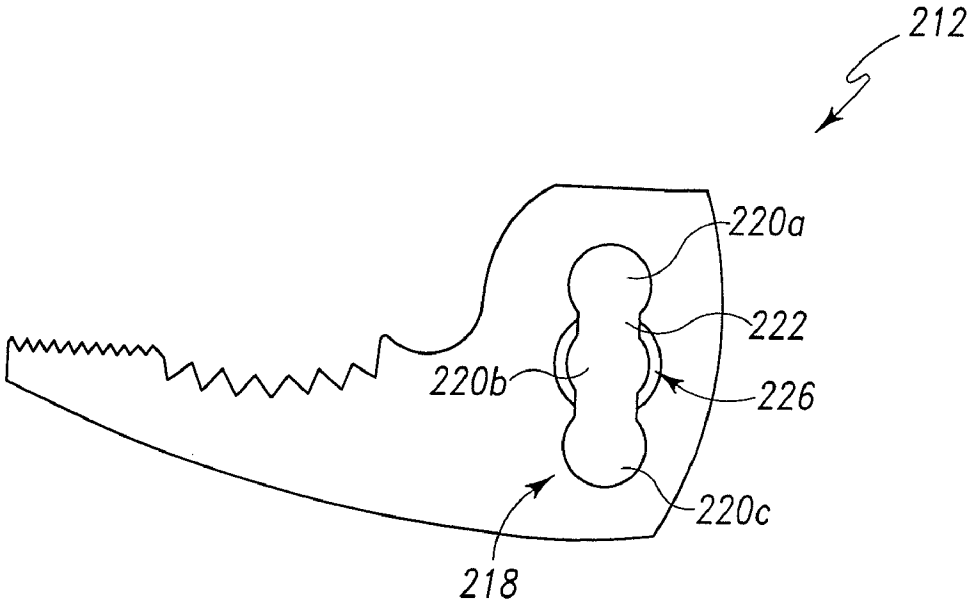
FIG. 2 is a side view of another embodiment of a jaw portion having a guide channel defined therein.

Referring to FIGS. 1-6, there is illustrated an adjustable tool, generally designated by the numeral 10. In the embodiments shown, the first digit of the reference number designates the embodiment being referenced. The remaining digits correspond to the general two digit reference number for each of the components common to each embodiment. For example, the embodiment of the adjustable tool in FIG. 2 is labeled as 210, while the adjustable tool of FIG. 3 is labeled as 310, and in FIG. 4 it is labeled 410. This nomenclature is followed as to all common elements.

Figure 6:
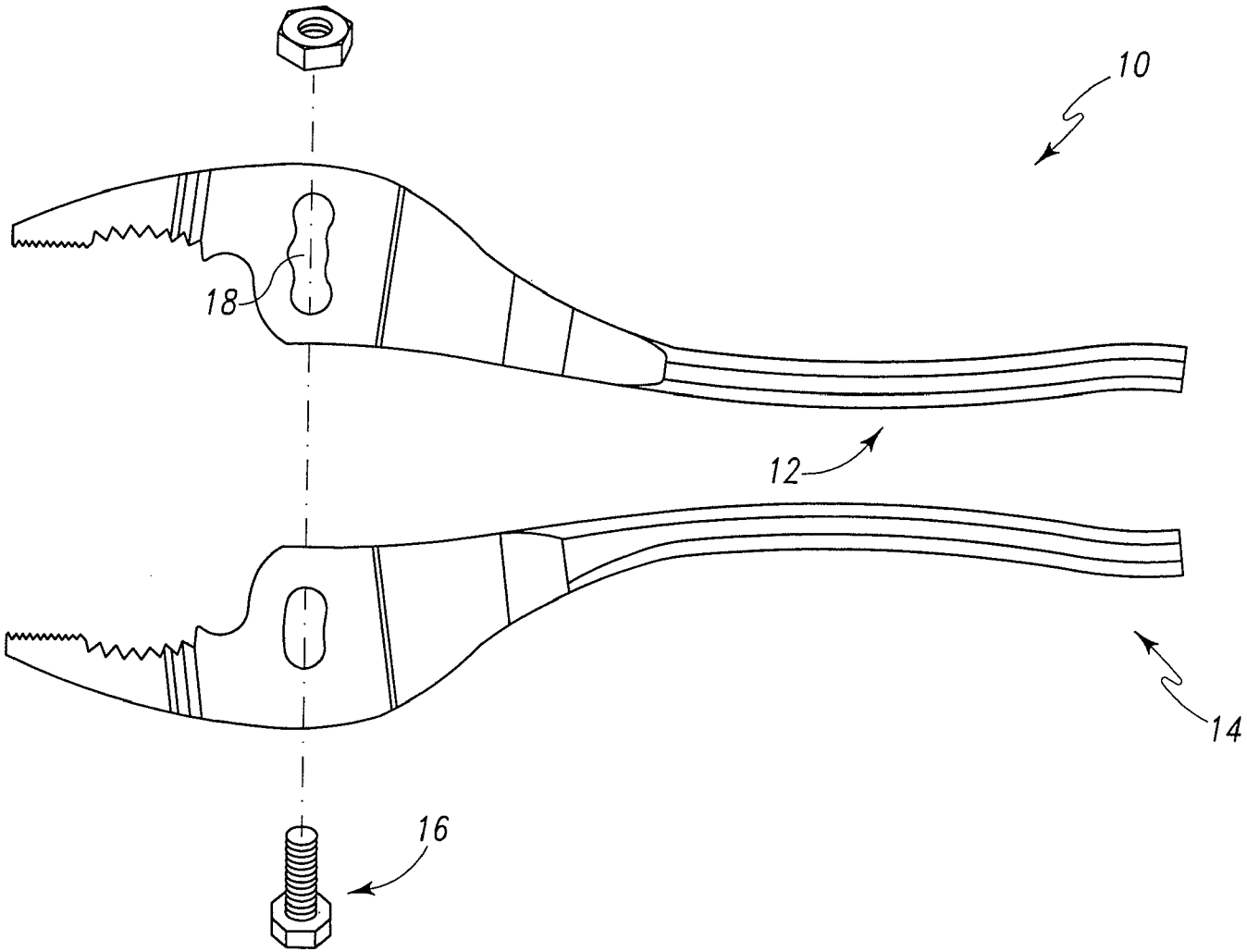
FIG. 6 is an exploded view of one adjustable tool suitable for any of the embodiments of the present invention.

The adjustable tool 10, shown to be a standard pair of pliers in the appended drawing figures, includes a first jaw portion 12 and a second jaw portion 14, each having a handle for user manipulation of the respective jaw portions 12, 14. The first and second jaw portions are pivotably connected to one another by the preferred use of a pivot pin 16 attached to (or through) one of the jaw portions and a guide channel 18 defined within the other of the jaw portions. The pivot pin 16 may be fixed to the jaw portion 14 via, for example, a weld, or it may be a separate part, as shown in FIG. 6, which passes through the jaw portion 14 before connecting with jaw portion 12.

The guide channel 18, as illustrated in FIGS. 1-5D and 6, is a generally scalloped structure having arcuate and inverse segments, and is preferably comprised of a plurality of pivot centers 20, particularly at least three centers, including two non-adjacent terminal centers 20*a*, 20*c* and at least one intermediate center 20*b*, and a plurality of slots 22 connecting the pivot centers 20 to one another. More specifically, each pivot center 20 is defined by arcuate segments, and the non-adjacent terminal pivot centers 20*a*, 20*c* are connected to the intermediate pivot center 20*b* by inverse segments. In one embodiment, the inverse segments are non-arcuate. The channel 18 is preferably a single pathway such that travel of the pivot pin 16 between non-adjacent pivot centers (e.g., terminal centers 20*a* and 20*c*) requires travel through at least one intermediate pivot center 20*b*. Also, the proper seating of the pivot pin 16 into each of the pivot centers 20 as it moves, creates a positive tactile indication to the user.

Creating the positive tactile indication can be accomplished in several different ways. The three illustrated embodiments of the present device disclose at least three suitable forms of creating a positive tactile indication of a properly seated pivot pin 16 in a pivot center 20.

While each of the illustrated embodiments is shown to have only three pivot centers 20, it should be understood that more pivot centers may be employed by adjusting the size (e.g., length, width, diameter, etc.) of the centers and adjoining slots to fit within a similarly sized guide channel 18. Accordingly, as the channel 18 is maintained at approximately the same length, it would be necessary to include more than three reduced-sized pivot centers 20. The pivot pin 16 would then also require a size alteration to accommodate the size reduced pivot centers 20. These mere size adjustments will be readily understood by those skilled in the art without more than the explanation above, the following description and the appended drawings.

Referring specifically to FIG. 1, a single jaw portion 112 of adjustable tool 110 is illustrated. In this embodiment, a single intermediate pivot center 120*b* connects to two slots 122. The center line 124 of each of the two slots 122 intersect to form an angle (α) having a measure in the range of from about 175 degrees to about 160 degrees. Preferably, the angle (α) is in the range of from about 170 degrees to about 166 degrees, and most preferably the angle (α) is about 168 degrees. The angle (α) creates a pathway for a pivot pin (16 of FIG. 6) which requires a slight direction change as it passes through intermediate pivot center 120*b* from either terminal pivot center 120*a* or 120*c*.

A pivot pin of the adjustable tool 110 would be capable of travel from pivot center 120*a*, through pivot center 120*b* to pivot center 120*c*, without leaving the single pathway—as opposed to, for example, a branched pathway such as a Y. However, as the pathway of the guide channel 118 does angle slightly from the pivot center 120*b*, movement of the pivot pin 16 (FIG. 6) from terminal center 120*a* to terminal center 120*c* requires a realignment at intermediate center 120*b* by the user. For this reason, there is a positive point during movement of the pin 116 which tactilely verifies to the user when the pivot pin is properly seated at pivot center 120*b*. Where additional intermediate pivot centers (not shown) are used, a similar angle deviation requiring a similar realignment and resulting in a similar positive tactile indication, as described in greater detail below, would be required. Of course, as pivot centers 120*a* and 120*c* are terminal centers on the pathway, there is also a clear and positive indication of proper seating in these pivot centers, as well.

As noted, in other forms of this embodiment, more than three pivot centers 120 may be used. In each case, however, there will always be only two terminal centers 120*a* and 120*c*. All other centers will necessarily be intermediate centers 120*b*. For example, the use of four (4) pivot centers would result in two (2) intermediate centers. Accordingly, to give the same positive center seating of the pivot pin, the obtuse angles (α) formed by connecting the center lines of adjacent slots to consecutive intermediate pivot centers would be flipped 180 degrees from each other—i.e., one would angle toward the tool jaws and the other would angle away from the tool jaws. Naturally, it is not required that the measure of such obtuse angles would be identical.

Referring to the embodiment of FIGS. 2 and 3, another single jaw portion 212 of an adjustable tool 210 is illustrated. The adjustable tool 210 of this embodiment is characterized by the intermediate pivot center(s) 220*b* having a recessed pocket 226 for seating the pivot pin 16 (FIG. 6). The pocket 216 need not be deep or large. The pocket 226 need only create a seat in which the user receives a positive tactile indication when the pivot pin 16 is properly positioned. By providing the pocket 226, the head of the pivot pin 16 will be engaged unlike any other point on the pathway as it travels from terminal center 220*a* to terminal center 220*c* through intermediate center 220*b*.

Unlike the previously described embodiment of FIG. 1 where the pathway was slightly angled, the single pathway in the embodiment of FIGS. 2 and 3 is preferably linear, i.e., at least substantially straight. However, it is certainly feasible that the angled slot configuration described above (adjustable tool 110) could be used in combination with the current pocket design (adjustable tool 210). Such a hybrid embodiment (not shown) would also provide the desired positive pivot center.

Figure 4:
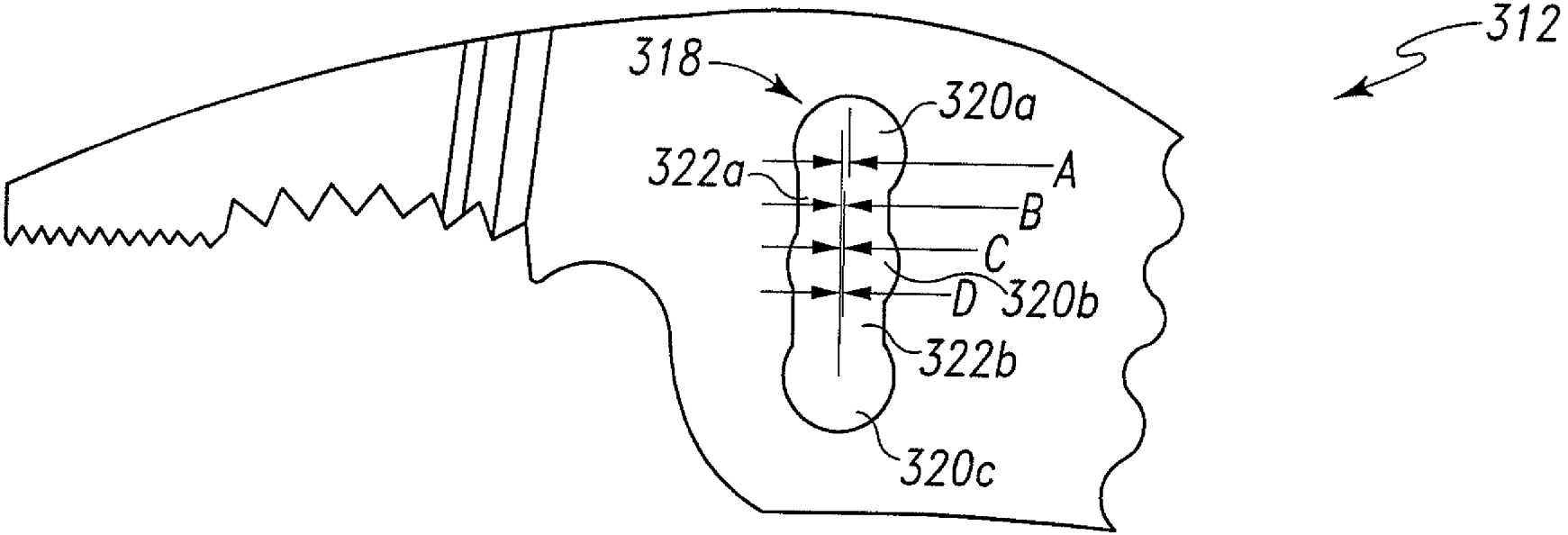
FIG. 4 is a side view of another embodiment of a jaw portion having a guide channel defined therein.
Figure 5A:
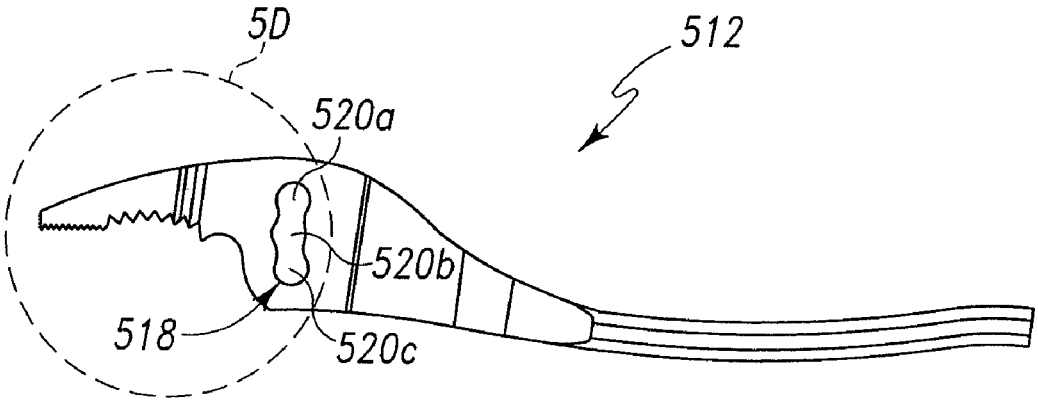
FIGS. 5A-5H are drawings showing several views of one embodiment in accordance with the present invention.
Figure 5B:
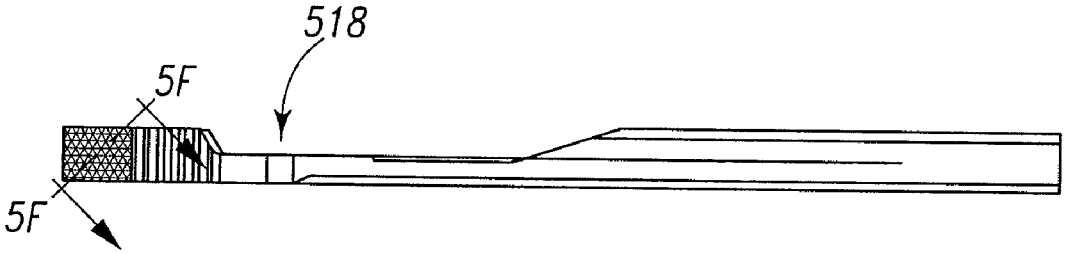
Figure 5C:
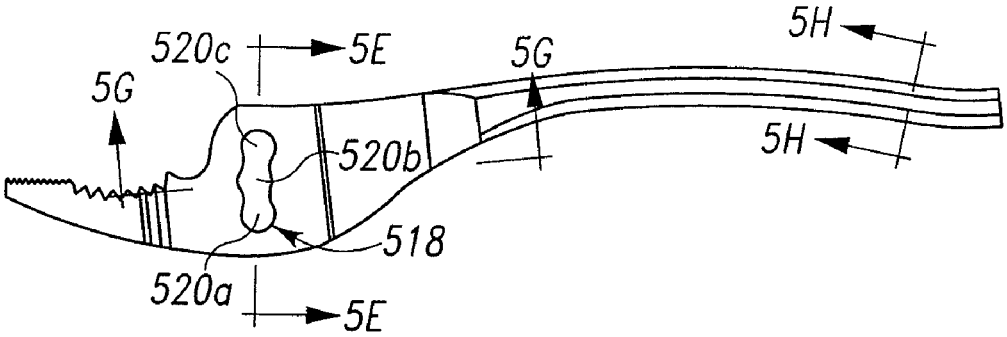
Figure 5D:
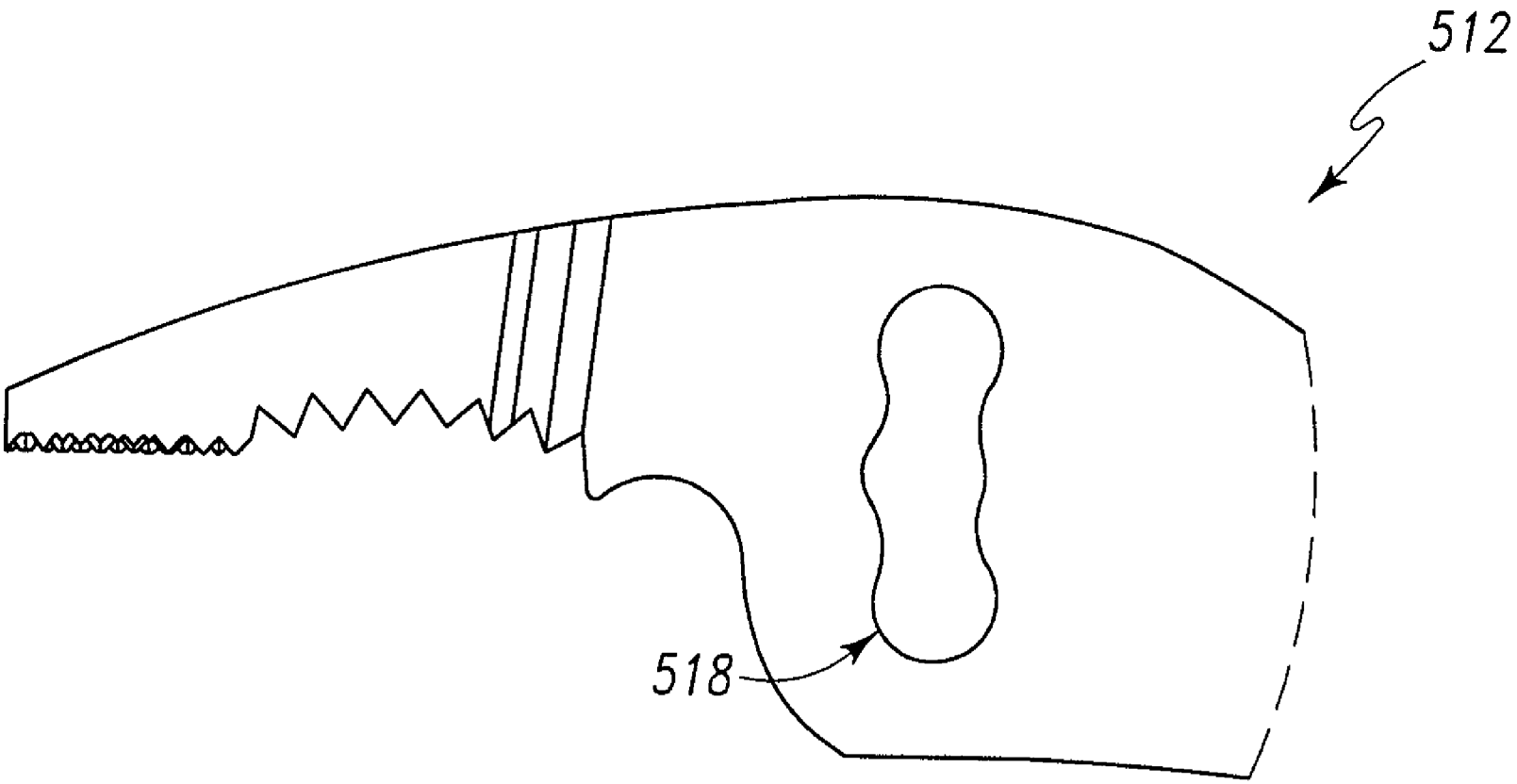
Figure 5E:
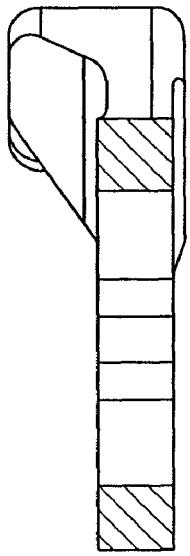
Figure 5F:
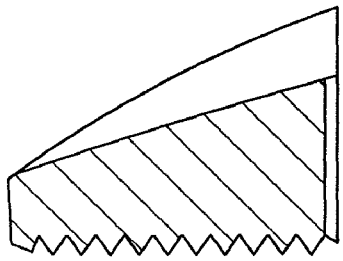
Figure 5G:
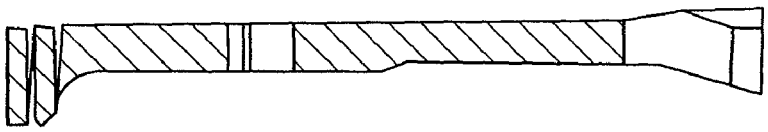
Figure 5H:
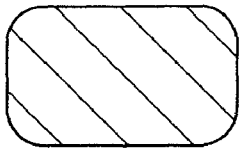

Referring now to the embodiment of FIG. 4, the adjustable tool 310 can be more readily understood. This embodiment is comprised of the same pivot centers 320 and slots 322 of the previous embodiments. That is, the width of each slot 322 is identical and the diameter of each pivot center 320 is identical and the slots 322 are all parallel. The distinguishing feature of this embodiment is that the center line of each slot 322 and the center point of each pivot center 320 is offset from that of adjacent slots and pivot centers.

For example, the center point of pivot center 320*a* is offset a distance (A) from the center line of slot 322*a*; the center line of slot 322*a* is offset a distance (B) from the center point of pivot center 320*b*; the center point of pivot center 320*b* is offset a distance (C) from the center line of slot 322*b*; and, the center line of slot 322*b* is offset a distance (D) from the center point of pivot center 320*c*. The offsets may be equal (i.e., A=B=C=D) or unequal and the offsets may be in the same or opposite directions—either alternating directions of the offsets or following some other pattern, including random, for such offsets.

The non-concentric alignment of the guide channel 318 components creates a positive seat for the pivot pin 16 (FIG. 6) at intermediate center 320*b* as the pin 16 travels from terminal center 320*a* to terminal center 320*c*. Preferably, the single pathway is linear or at least substantially linear, as the slots 322 are all parallel but may be slightly offset to create the positive tactile indication for the user.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. An adjustable tool comprising:

a first jaw portion including a first channel;

a second jaw portion including a second channel;

a pivot pin adapted to extend through the first channel and the second channel to movably couple the first jaw portion to the second jaw portion, wherein at least one of the first channel and the second channel include:

a plurality of pivot centers adapted to receive the pivot pin, wherein the at least one of the first channel and the second channel includes two non-adjacent terminal pivot centers and at least one intermediate pivot center, each pivot center being connected to at least one other pivot center by a slot to form a single pathway such that travel of the pivot pin between non-adjacent pivot centers requires travel through at least one of the at least one intermediate pivot center; and each of the plurality of linear pathways connecting the pivot centers being substantially parallel to one another and being aligned along a respective centerline, and wherein a center line of each slot and a center point of each pivot centers is offset from that of adjacent slots and pivot centers; and proper seating of the pivot pin in each pivot center creates a positive tactile indication.

2. The adjustable tool of claim 1, wherein the number of pivot centers is three.

3. The adjustable tool of claim 1, wherein the pivot centers include two or more intermediate pivot centers is two or more.

4. The adjustable tool of claim 3, wherein each of the at least one intermediate pivot centers comprises a surface alteration which creates a change in the pivot pin when properly seated.

5. The adjustable tool of claim 4, wherein the surface alteration of each intermediate pivot center comprises a recessed pocket about the pivot center.

6. The adjustable tool of claim 4, wherein the number of intermediate pivot centers is three.

7. The adjustable tool of claim 4, wherein the number of intermediate pivot centers is two or more.

* * * * *